US006966104B2

(12) United States Patent
Gregel et al.

(10) Patent No.: US 6,966,104 B2
(45) Date of Patent: Nov. 22, 2005

(54) REINFORCING BAR TOOL AND METHOD

(75) Inventors: John J. Gregel, Bedford, OH (US); Glenn T. Siracki, Mantua, OH (US)

(73) Assignee: Erico International Corporation, Solon, OH (US)

( * ) Notice: Subject to any disclaimer, the term of this patent is extended or adjusted under 35 U.S.C. 154(b) by 303 days.

(21) Appl. No.: 10/055,399

(22) Filed: Jan. 23, 2002

(65) Prior Publication Data

US 2002/0112337 A1 Aug. 22, 2002

Related U.S. Application Data

(60) Provisional application No. 60/346,712, filed on Jan. 8, 2002, provisional application No. 60/263,860, filed on Jan. 23, 2001.

(51) Int. Cl.[7] ..... B25B 27/14

(52) U.S. Cl. ..... 29/280; 29/252; 29/282; 29/464; 403/310; 403/305; 81/301; 81/342; 81/349; 81/351; 81/418; 269/34; 269/231; 269/236; 269/237

(58) Field of Search ..... 29/517, 525, 237, 29/252, 268, 280, 282, 464, 468, 271, 525.11, 29/456, DIG. 41, DIG. 18; 269/34, 43, 217, 269/231, 233, 234, 236, 237; 81/301, 342, 81/349, 351, 353, 418, 419; 285/39; 403/305, 403/307, 310; 72/89, 103; 52/726.1; 289/39

(56) References Cited

U.S. PATENT DOCUMENTS

| | | | | |
|---|---|---|---|---|
| 50,190 A | | 9/1865 | Watson | |
| 1,377,101 A | | 5/1921 | Sparling | |
| 2,739,373 A | * | 3/1956 | Kane, Jr. | 29/237 |
| 2,958,125 A | * | 11/1960 | Nichols | 29/237 |
| 2,992,576 A | * | 7/1961 | Evans et al. | 72/409.08 |
| 3,022,510 A | * | 2/1962 | O'Malley | 227/78 |
| 3,217,519 A | * | 11/1965 | Demler | 72/19.7 |
| 3,281,929 A | * | 11/1966 | Shinnick | 29/237 |
| 3,323,201 A | * | 6/1967 | Fisher | 29/238 |
| 3,480,309 A | | 11/1969 | Harris | 287/110 |
| 3,551,999 A | | 1/1971 | Gutmann | 29/517 |
| 3,585,704 A | * | 6/1971 | Schroeder | 29/235 |

(Continued)

FOREIGN PATENT DOCUMENTS

DE 1659247 2/1971

(Continued)

OTHER PUBLICATIONS

Stricon Products Ltd., *"The Stricon Ultimate Stress Splicer"*.

(Continued)

*Primary Examiner*—Essama Omgba
(74) *Attorney, Agent, or Firm*—Renner, Otto, Boisselle & Sklar, LLP

(57) ABSTRACT

A tool for forming a high strength reinforcing bar coupling driving self-locking wedge sleeves over each end of a contractible jaw assembly bridging the abutting ends of the bar to be joined. The sleeves are seated in collars engaged by the distal ends of arms driven for closure by a piston-cylinder power unit and a cam on at least one arm. In one form the cam on one arm is engaged by a roller connected by a tension link to the other arm. In another form cams are provided on each arm driven by rollers fixed with respect to each other. The collars include self-releasing collets seating the sleeves. The tool has other uses such as bar shearing or forming.

42 Claims, 5 Drawing Sheets

U.S. PATENT DOCUMENTS

| | | | | | |
|---|---|---|---|---|---|
| 3,653,115 | A | * | 4/1972 | Perkins | 29/237 |
| 3,769,678 | A | * | 11/1973 | Marsden | 72/412 |
| 3,789,493 | A | * | 2/1974 | Province | 29/282 |
| 3,969,920 | A | * | 7/1976 | Marsden et al. | 72/415 |
| 4,241,490 | A | | 12/1980 | Edwards | 29/459 |
| 4,408,926 | A | * | 10/1983 | Werner | 403/310 |
| 4,469,465 | A | | 9/1984 | Andrus | 403/282 |
| 4,598,452 | A | * | 7/1986 | Iseki | 29/237 |
| 4,710,052 | A | | 12/1987 | Elger | |
| 4,722,468 | A | * | 2/1988 | McClure | 228/49.3 |
| 4,848,971 | A | | 7/1989 | Price Jr. | 405/259 |
| 4,850,777 | A | | 7/1989 | Lawrence et al. | 411/433 |
| 4,872,709 | A | * | 10/1989 | Stack | 285/39 |
| 5,099,561 | A | * | 3/1992 | Santiago Lozano | 29/237 |
| 5,226,231 | A | * | 7/1993 | De Leebeeck | 29/237 |
| 5,308,184 | A | | 5/1994 | Bernard | 403/305 |
| 5,513,425 | A | * | 5/1996 | Williams | 29/237 |
| 5,640,748 | A | * | 6/1997 | Harrison | 29/272 |
| 5,749,604 | A | * | 5/1998 | Williams | 285/39 |
| 6,089,779 | A | | 7/2000 | Lancelot, III | 403/313 |
| 6,099,196 | A | | 8/2000 | Lancelot, III | 403/313 |
| 6,272,738 | B1 | * | 8/2001 | Holliday et al. | 29/751 |
| 6,314,629 | B1 | * | 11/2001 | Showalter et al. | 29/237 |
| 6,327,763 | B2 | * | 12/2001 | Stephen | 29/272 |
| 6,508,149 | B1 | * | 1/2003 | Heggemann et al. | 81/320 |
| 6,612,206 | B1 | * | 9/2003 | Heggemann et al. | 81/342 |
| 6,719,478 | B2 | * | 4/2004 | Gregel et al. | 403/310 |
| 2002/0101017 | A1 | * | 8/2002 | Kolarik | 269/43 |
| 2005/0120539 | A1 | * | 6/2005 | Tutt et al. | 29/466 |

FOREIGN PATENT DOCUMENTS

| | | |
|---|---|---|
| FR | 2558904 A1 | 1/1984 |
| GB | 974442 | 11/1964 |
| GB | 1432888 | 4/1976 |
| WO | 93/24257 | 12/1993 |
| WO | 00/66852 | 11/2000 |

OTHER PUBLICATIONS

Concrete Reinforcing Steel Institute Pamphlet entitled, *"Reinforcement Anchorages and Splices"*, 4th ed. (1997).

Quick Wedge, Manufactured by ERICO®, Inc. (1992).

CCL Systems Limited, *"CCL Alpha Splice"*.

Blitz Corporation, PM Blitz Coupler, *"Blitz Splice the Ultimate Rebar Connection"*.

Stricon Products Ltd., *"The Stricon Ultimate Stress Splicer"*.

Concrete Reinforcing Steel Institute Pamphlet entitled, *"Reinforcement Anchorages and Splices"*, 4th ed. (1997).

Quick Wedge, Manufactured by ERICO®, Inc. (1992).

* cited by examiner

REINFORCING BAR TOOL AND METHOD

This application claims priority from U.S. Provisional Application No. 60/263,860, titled "Reinforcing Bar Connection and Method," filed Jan. 23, 2001, and from U.S. Provisional Application No. 60/346,712, titled "Reinforcing Bar Toll and Method," filed Jan. 8, 2002.

This invention relates generally as indicated to reinforcing bar tool and, more particularly, to a tool and method for quickly field or shop cutting, forming or coupling reinforcing bar.

BACKGROUND OF THE INVENTION

In a prior application there has been developed a reinforcing bar splice or coupling which involves driving a low angle self-locking wedge sleeve over each end of a contractabile jaw assembly causing the jaw assembly to close and engage or grip abutting bar ends to form a high strength splice or coupling. The jaw assembly includes teeth which may cold form, engage, and grip the bar ends penetrating the overall diameter of the bar but not the nominal bar diameter or core. In this manner a high strength connection is formed. When correctly assembled, the bar coupling forms a high compressive and tensile strength coupling qualifying as a Type 2 mechanical connection in all United States earthquake zones. The coupling has been developed by ERICO International Corporation of Solon, Ohio, U.S.A., under the trademark LENTON® LOCK™. LENTON® is a registered trademark of ERICO.

While forming such a high strength coupling is a relatively easy task in a lab or shop using elaborate power bench equipment such as presses, field forming these high strength couplings is an entirely different matter. Such couplings can be used horizontally or vertically in columns, or even diagonally. The installation may be at considerable height, in very limited space, and in all kinds of weather conditions. There is probably no work environment more confining, complex and difficult than the arduous installation and erection of steel reinforcing for concrete construction. Laboratory or plant equipment simply is not suitable in a field application. There is, accordingly, a need for a tool useful both in the field or shop for forming such high strength connections or couplings. It would also be desirable if the tool had other uses and applications in the steel reinforced concrete contraction industry.

SUMMARY OF THE INVENTION

It is, accordingly, an object of the inventor to provide a tool which can quickly make high strength couplings in the field as well as in a shop. It is also an object to provide a tool fully field capable of installing multiple reinforcing bar coupling sizes and which may be automated, obtain a mechanical advantage, provide a constant closing force range at the end of the closing stroke, and which may use variable power requirements to adjust the force applied depending on bar size. It is a further object to provide a tool having other uses in reinforced concrete construction such as bar shearing or bending.

It is an aspect of the invention to provide a tool for forming a reinforcing bar connection having opposed drivers each adapted to engage a collar seating a tapered sleeve, with the collars and the tapered sleeves positioned over bar ends, the collars being driven axially of the bar ends to force the sleeves over the opposite ends of a jaw assembly positioned on the bar ends to cause the jaw assembly to contract and grip the bar ends.

It is another aspect to provide a tool for forming a reinforcing bar splice having a pair of pivoting arms, the distal ends of which engage and drive oppositely facing sleeve seats positioned over aligned bar ends, with power means to drive the seats axially of the bar ends to force the sleeves over the jaw assembly positioned on the bar ends to cause the jaw assembly to contract to grip and splice the bar ends.

It is yet another aspect to provide a method of forming a reinforcing bar coupling comprising the step of placing oppositely directed self-locking wedge sleeves over the butting ends of the reinforcing bar to be joined, placing a contractible jaw assembly over the butting ends, seating the sleeves in collars, and then activating a driving tool to force the collars and wedge sleeves toward each other and over the jaw assembly to contract the jaw assembly and form the coupling.

It is also an important aspect of this invention to provide a power operated rebar tool having pivoting arms with the distal end of each arm provided with a notch accommodating reinforcing bar, each distal end also including a bearing section on each side of the notch operative to engage and drive rebar tooling when the arms are closed.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
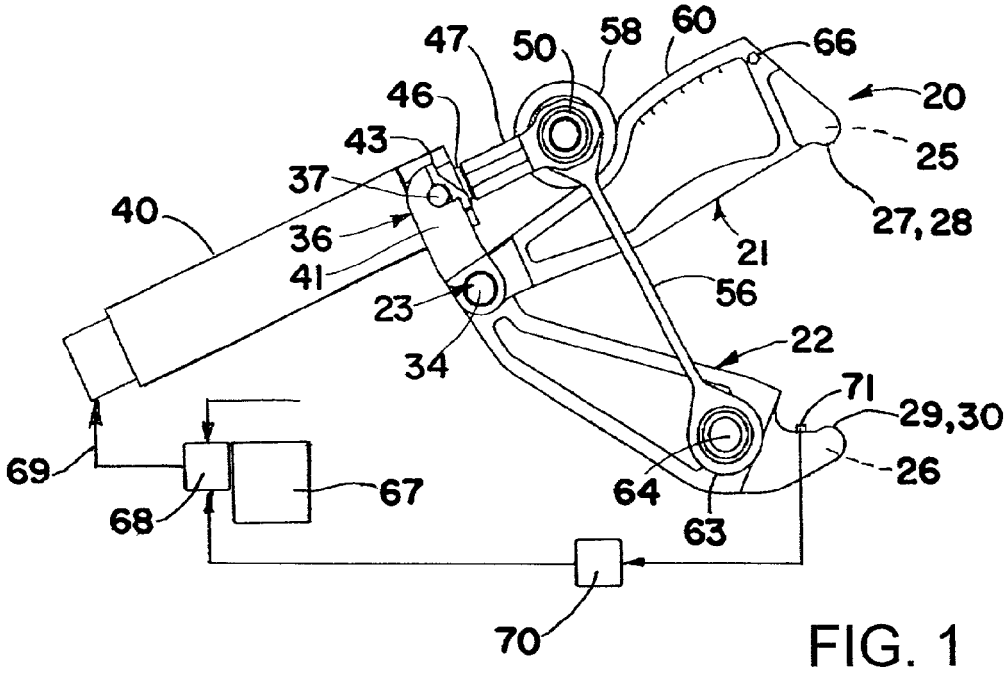
FIG. 1 is a side elevation of a tool in accordance with the present invention also showing, schematically, a control circuit.
Figure 2:
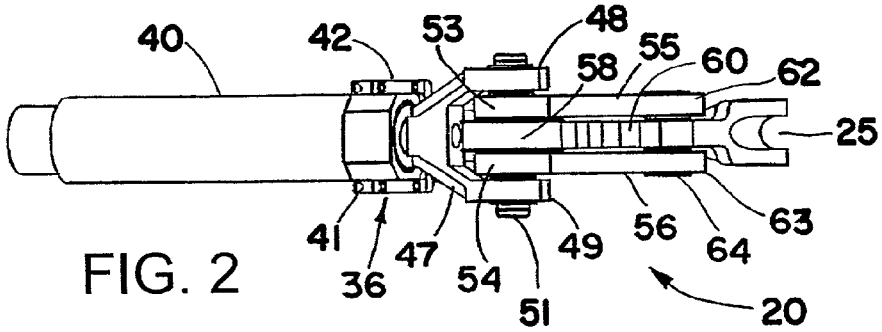
FIG. 2 is a top plan view of the tool of FIG. 1.
Figure 3:
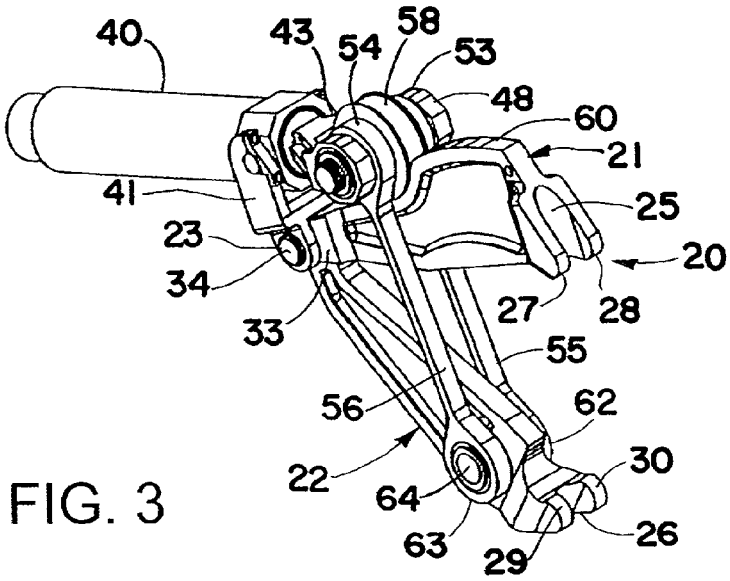
FIG. 3 is a perspective view of the tool of FIG. 1.

Referring initially to FIGS. 1 through 3, there is illustrated a tool shown generally at 20 which comprises an upper arm 21 and a lower arm 22 which are coaxially pivoted together at their proximal ends as indicated at 23. A distal or outer end of each arm is provided with a notch, shown at 25 and 26, respectively, the notch extending in the plane of movement of the arms which would be the plane of FIG. 1 or normal to FIG. 2. When the tool is utilized to form a coupling, the notches accommodate reinforcing bar passing therethrough.

As seen more clearly in FIG. 3, the distal end of each arm includes the bearing section on each side of the notch which is operative to engage and drive rebar tooling when the arms are closed. Each bearing section is rounded or curved and for the distal end of the upper arm 21 the bearing sections are shown at 27 and 28. For the distal end of the lower arm the bearing sections are shown at 29 and 30. The bearing sections engage the tooling diametrically opposite any bar or rod passing through the notch and the rounded configuration of the bearing sections maintains the desired contact with the tooling being used with the tool.

As can be seen in FIG. 3, the upper arm 21 includes a proximal clevis or fork 33, which accommodates the proximal end of the lower arm 22 and enables the arms to be pivoted together by the pin 34, forming the pivot 23.

Also mounted on the pivot pin 34 is a support bracket shown generally at 36 which provides a pivot support 37 at the rod end piston-cylinder assembly 40. The bracket 36 has two upstanding arms on each side of the cylinder seen at 41 and 42 with the cylinder pivot being held in place by removable keepers 43 at the upper end of each arm. The bracket 36 fits snugly over and under the proximal end of the upper arm 21 and is thus a rigid extension of that arm.

The rod 46 of the piston-cylinder assembly is connected to a clevis 47 which has separated arms 48 and 49 supported by spherical bearings 50 on shaft 51. Also mounted on the shaft, each with its own spherical bearing are the eyes 53 and 54 of tension links 55 and 56, respectively, as well as cam roller 58. The cam roller 58 is in the center of the pivot pin and may be slightly flanged to ride on cam surface 60 on the top of the upper arm 21.

The eyes 62 and 63 at the lower end of the tension links 55 and 56 are supported by spherical bearings on the ends of pivot pin 64 pivotally connecting the tension links to the lower arm 22.

It can now be seen that as the piston-cylinder assembly 40 extends, the roller 58 will ride over the cam 60 causing the arms to pivot about their proximal ends toward each other, closing the tool for a variety of tasks such as forming a rebar coupling, shearing or cutting rebar, or forming or bending rebar.

As seen more clearly in FIG. 1 the upper pivoting arm 21 is provided with a hole 66 which may accommodate a handle which may manually open the arms when the piston-cylinder assembly is retracted. Return springs may also be provided if desired. FIG. 1 also illustrates schematically a hydraulic circuit for the piston-cylinder assembly 40 which includes a power supply 67 and a pressure regulator 68 supplying fluid pressure to the blind end of the piston-cylinder assembly as indicated at 69. The pressure regulator may also be controlled from a controller 70, in turn controlled by a proximity switch 71 positioned in the receiving end of the distal end of the lower arm 22. The proximity switch is positioned a distance from the diametral bearing surfaces 29 and 30 and is used to sense the size of the reinforcing bar being accommodated by the tool. In this manner the sensor will recognize the reinforcing bar size and through the pressure regulator will automatically adjust the fluid pressure for the size of bar positioned in the tool.

As can be seen, the embodiment of FIG. 1 has coaxially pivoted arms and a single cam 60 which is the upper edge of the upper arm 21. The cam 60 is selected so that the concluding portion of the closing stroke generates a constant closing force range. This accommodates variations in reinforcing bar diameter, per nominal size, and the tool automatically stops when appropriate closing force is achieved. A sensor may be provided both to notify the operator when the proper coupling connection has been made and to reverse the piston-cylinder assembly.

Figure 4:
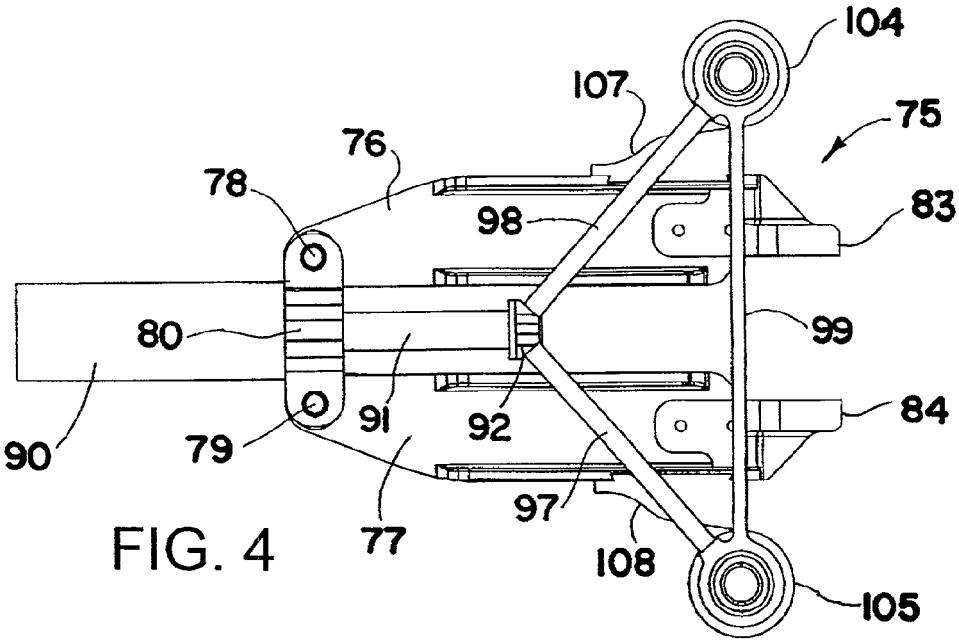
FIG. 4 is a side elevation of a modified form of tool in accordance with the invention.
Figure 5:
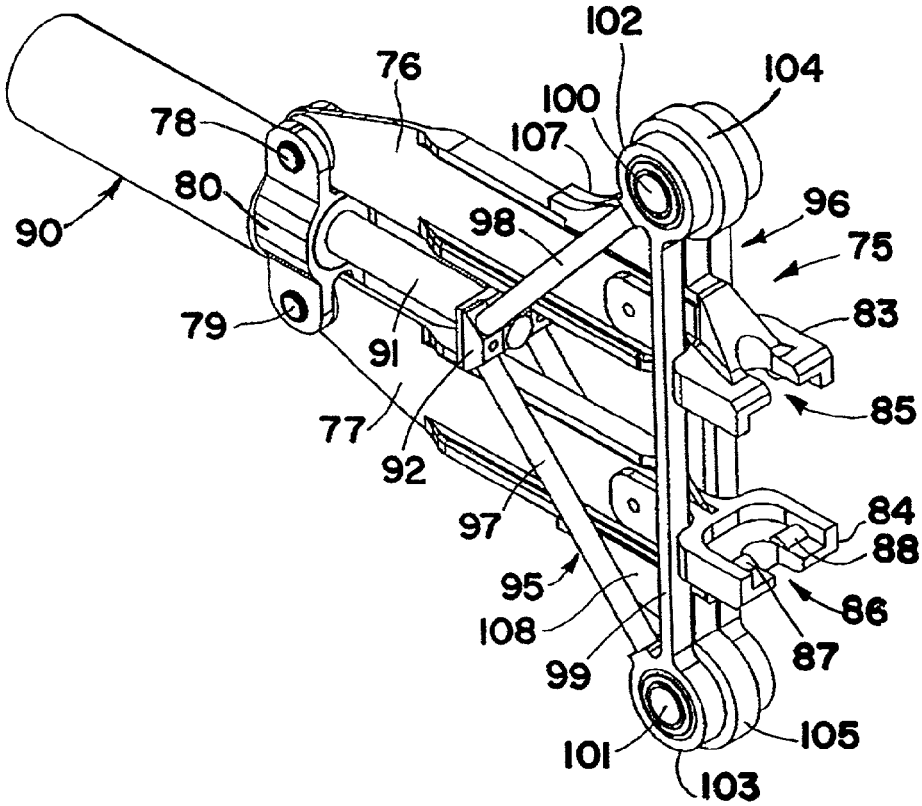
FIG. 5 is a perspective view of the tool of FIG. 4.

Referring now to FIGS. 4 and 5 there is illustrated another embodiment of a tool in accordance with the present invention shown generally at 75. This illustrated embodiment of the tool includes two pivoting arms 76 and 77 proximally pivoted at pins 78 and 79, respectively, to rod end cylinder bracket 80. The distal ends of the arms are provided with removable projecting receivers indicated at 83 and 84, respectively, each having a notch as seen at 85 and 86. Each receiver also includes the diametrically opposed rounded bearing surfaces seen more clearly in FIG. 5 at 87 and 88.

The piston-cylinder assembly 90 is joined to the arms through the bracket 80, and the rod 91 has secured to the end thereof a triangular yoke 92 which supports the apex of two laterally spaced triangular trusses shown generally at 95 and 96. Each truss includes angularly related compression members 97 and 98 and a tension member 99 connecting pins 100 and 101 at each end through the eyes shown at 102 and 103, respectively. Positioned between the eyes of the laterally spaced trusses are cam rollers shown generally at 104 and 105. The eyes of the spaced trusses as well as the cam rollers may be mounted on the respective pins 100 and 101 each with suitable spherical bearings. The cam rollers 104 and 105 engage cams 107 and 108, respectively, which are removably mounted on the exterior of the pivoting arms 76 and 77, respectively.

With the tool of FIGS. 4 and 5 the proximal ends of the arms are pivoted offset from each other on each side of the piston-cylinder assembly 90, and cams on both arms are engaged by respective rollers on the ends of the trusses to translate the linear movement of the power means to closing movement of the arms. A return spring may be provided between the two arms urging the two arms to an open position. In any event as pressure in the piston-cylinder assembly at the blind end moves the rod 91 to the right as seen in FIGS. 4 and 5, the two arms pivot toward each other closing the receivers 83 and 84 on the reinforcing bar tooling within the receivers either to form a coupling, cut or shear reinforcing bar, or form it, for example.

Figure 6:
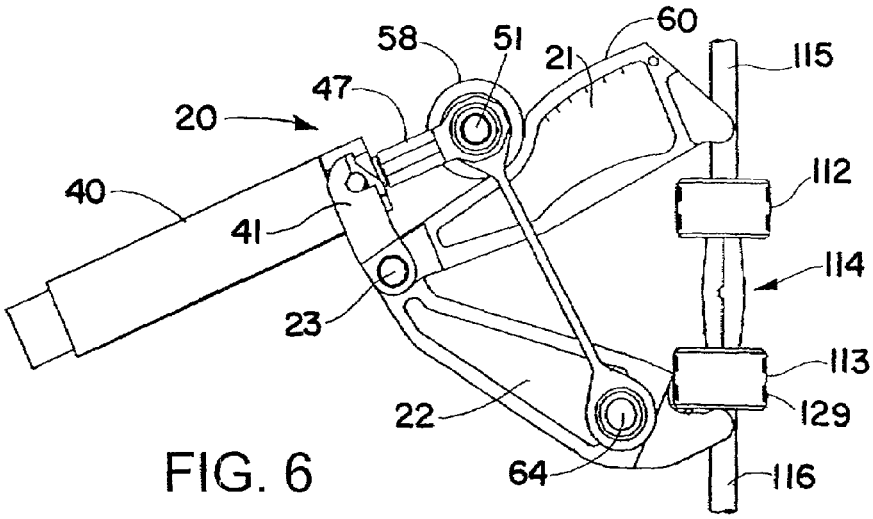
FIG. 6 is a side elevation of the tool of FIG. 1 with the bar and coupling to be formed in position.
Figure 7:
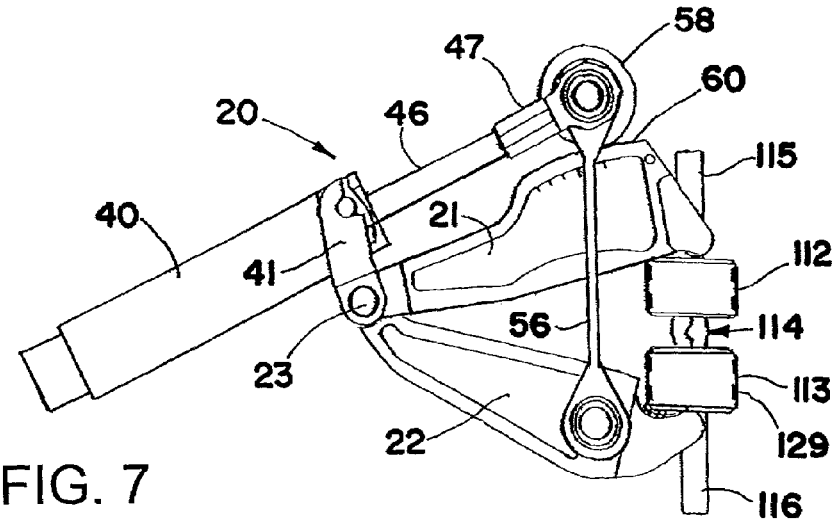
FIG. 7 is a similar side elevation with the tool closed engaging and driving the collars and sleeves toward each other to form the coupling.
Figure 8:
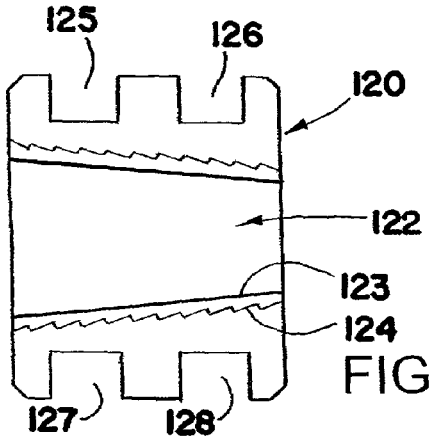
FIG. 8 is an elevation of a collar segment in the plane of its axis and including a self-releasing collet segment.

Referring now to FIGS. 6, 7 and 8 there is an illustration of the tool forming a LENTON® LOCK™ coupling in accordance with the invention. In FIG. 6 the tool is open and the receiver or distal ends of each of the arms is positioned, respectively, above and below collars 112 and 113 positioned at each end of the splice 114 forming the coupling joining the reinforcing bars 115 and 116 end-to-end. The coupling splice 114 is shown in greater detail in FIG. 11 and 12 hereinafter described.

As seen in FIG. 8 the collars 112 and 113 may be formed from half-round collar sections 120 each of which includes a tapered opening 122 which in turn supports a self-releasing collet section shown generally at 123. The collet section is supported in the collar section by a series of sloping surfaces indicated at 124 so that when the pressure of the tool is released, the collet sections will release the self-locking wedge sleeves seen in more detail in FIG. 11. The half-round collar sections are provided with slots 125 and 126 on one side and slots 127 and 128 on the other side. These slots are designed to receive keys shown at 129 in FIGS. 6 and 7 which hold the two halves of the collar together forming the annular seat for the wedge sleeve.

As seen in comparing FIGS. 6 and 7 the piston-cylinder assembly 40 has been extended and the arms have closed with the round bearing surfaces engaging diametrically opposite sides of the collar formed by the half-round sections driving the wedge sleeves toward each other and over the coupling jaw assembly 114. This causes the jaw assembly to contract to grip the end-to-end bars 115 and 116 forming a Type 2 splice. When the assembly is completed, the tool is removed and the collars 112 and 113 are disassembled and removed for reuse.

Figure 9:
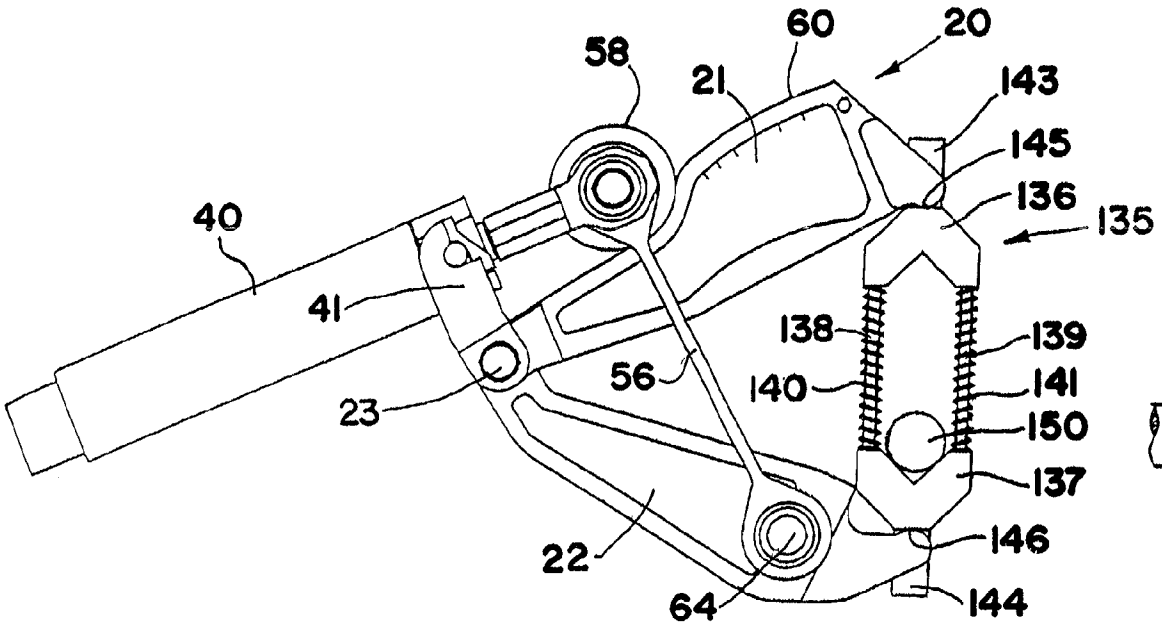
FIG. 9 is a side elevation of the tool driving a bar shearing fixture.

Referring now to FIG. 9, it will be seen that the same tool 20 is being used to operate a bar shear fixture shown generally at 135. The upper and lower blade assemblies 136 and 137 are connected by two guide rods seen at 138 and 139 each surrounded by a return compression spring 140 and 141. The shearing blade assemblies are provided with oppositely projecting, relatively short rods indicated at 143 and 144. The curved bearing areas of the distal ends of the arms engage shoulders 145 and 146 on opposite sides of the rod extension. In this manner the tooling may quickly be driven to a closed or shut position shearing bar 150.

Figure 10:
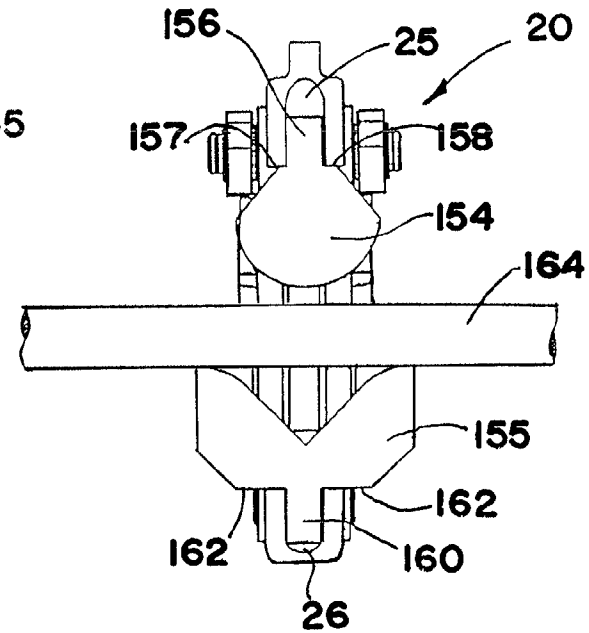
FIG. 10 is an end elevation of the tool driving a bar forming or bending fixture.

FIG. 10 illustrates a bar bending or forming fixture which includes male tooling element 154 and female element 155 positioned in the receiver ends of the arms of the tool. Like the shear tooling, the male tooling 154 includes a rod extension 156 filling in notch 25 providing shoulders 157 and 158 on each side thereof to be engaged by the bearing areas of the distal end of the upper arm. Similarly, the female tool 155 includes rod extension 160 fitting in the notch 26 with shoulders 161 and 162 on each side for engagement by the bearing areas of the distal end of the lower arm. Using the tooling illustrated, the bar 164 may quickly be bent to the desired configuration.

Figure 11:
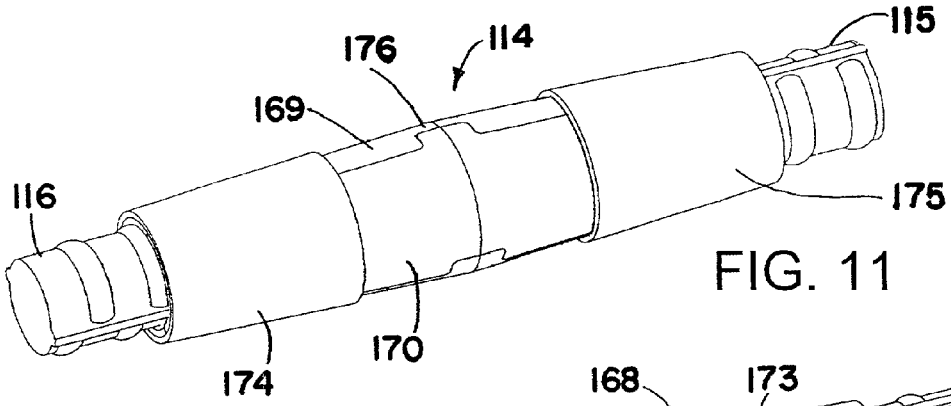
FIG. 11 is a perspective view of a completed LENTON® LOCK™ coupling as formed by the tool of the present invention.
Figure 12:
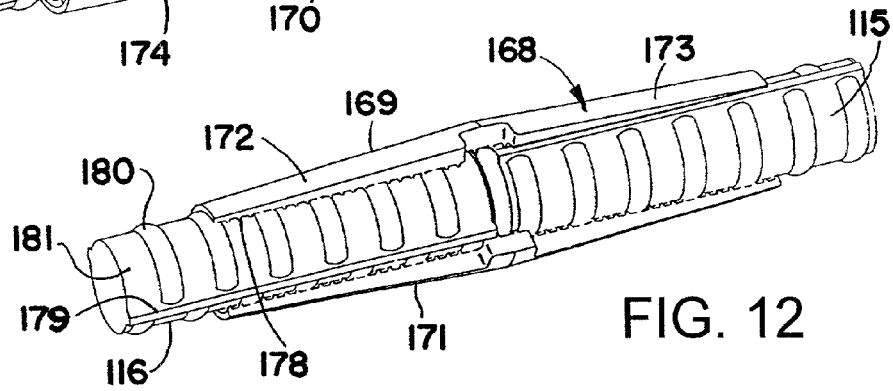
FIG. 12 is a similar view with the self-locking wedge collars and one jaw of the jaw assembly removed.

Referring now to FIGS. 11 and 12 there is illustrated a LENTON® LOCK™ coupling which the tool of the present invention completes. The coupling shown generally at 114 is joining end-to-end axially aligned deformed reinforcing bars 115 and 116. The bars are, of course, shown broken away so that only the ends gripped by the splice or connection are illustrated. The connection comprises a jaw assembly shown generally at 168 which includes three circumferentially interfitting jaw elements shown at 169, 170 and 171. In FIG. 12 the jaw element 170 has been removed. The exterior of the jaw elements form oppositely tapering, shallow angle surfaces 172 and 173 on which the tool of the present invention drives the matching taper lock sleeves 174 and 175. It is noted that the jaw sections have interfitting portions indicated at 176 keeping the jaw elements properly assembled. When the locking sleeves are driven toward each other by the tool of the present invention, the jaw assembly contracts driving the interior teeth 178 on each jaw element into the deformed, or projecting portions of the bar such as the longitudinally projecting ribs 179 or the circumferential ribs 180, but not the core 181.

The diameter bar at the core represents the nomial diameter of the bar while the overall diameter includes the longitudinal or circumferential ribs. In any event, the tool of the present invention can quickly complete the coupling seen in FIG. 11.

Figure 13:
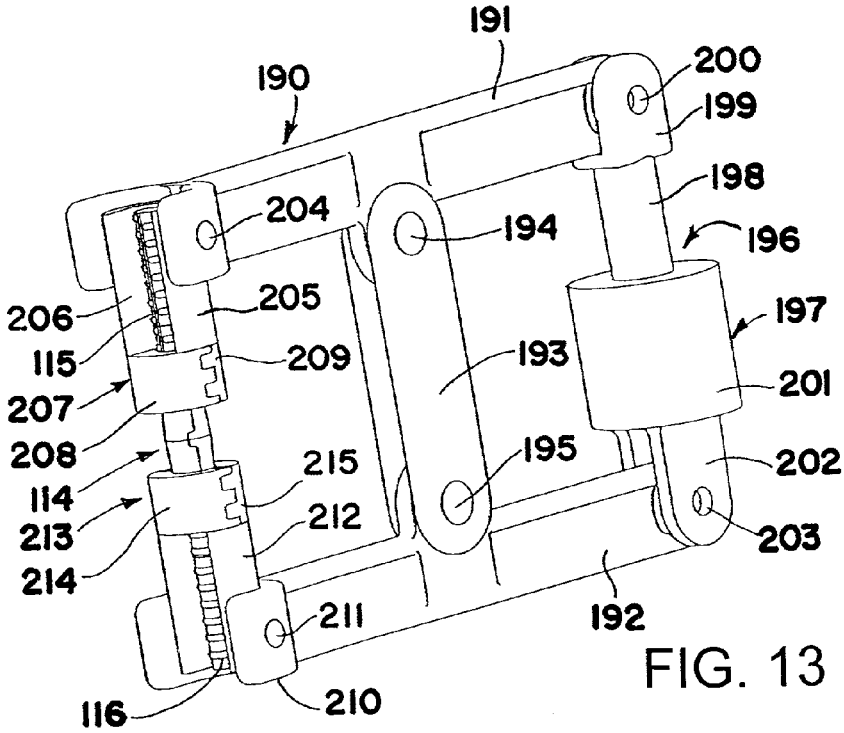
FIG. 13 is a perspective view of another embodiment of a rebar tool.

Referring now to FIG. 13, there is illustrated another tool shown generally at 190 for completing the splice or connection of the present invention. Although the tool is shown connecting the bars 115 and 116 vertically oriented, it will be appreciated that the bars and splice may be horizontally or even diagonally oriented. The tool includes generally parallel levers 191 and 192 connected by center link 193 pivoted to the approximate mid-point of such levers as indicated at 194 and 195. Connecting the outer or right-hand end of the levers 191 and 192 is an adjustable link shown generally at 196 in the form of a piston-cylinder assembly actuator 197. The rod 198 of the assembly is provided with a clevis 199 pivoted at 200 to the outer end of lever 191. The cylinder 201 of the assembly 197 is provided with a mounting bracket or clevis 202 pivoted at 203 to the outer end of lever 192.

The opposite end of the lever 191 is provided with a C-shaped termination pivoted at 204 to a C-shaped tubular member 205 having an open side 206. A wedge driving collar shown generally at 207 is mounted on the lower end of the open tube 205. The collar is formed of hinged semi-circular halves 208 and 209. When closed and locked the wedge collar has an interior taper matching that of the self-locking sleeves 174 and 175.

The lower arm 192 is provided with a C-shaped termination 210 pivoted at 211 to open tube 212 supporting wedge collar 213 formed of pivotally connected semi-circular halves 214 and 215. When the piston-cylinder assembly is extended, the collars are driven toward each other.

In any event, with the various tool embodiments of the present invention the splice as illustrated in FIG. 11 can quickly and easily be made.

The tool of the present invention is capable of installing multiple rebar splice sizes and automatically stops when appropriate closing force is achieved. The tool accommodates variations in rebar diameter, per nominal size, by means of a constant closing force range at the concluding portion of the closing stroke and will function with all types and grades of rebar. The tool provides quick installation times for a bar break coupling in but one actuation of the tool. The tool can, however, perform other tasks in the rebar construction industry such as bar shearing or bar forming or bending.

Although hydraulic piston-cylinder assemblies and controls are preferred, it will be appreciated that other types of power actuators may be employed. The preferred form of tool seen, for example, in FIG. 1 provides force multiplication obtained through the combination of the power unit in conjunction with mechanical cam surface and the rotating tension link. Multiplication also can be achieved with the combination of the power unit and mechanical cams with the translating truss assembly of the FIG. 4 embodiment.

The tool is versatile, light weight, and may have a variety of uses in the steel reinforced concrete construction industry. For example, the components of the tool may be made of 4140 steel and the tool is readily portable at a field or construction site.

To the accomplishment of the foregoing and related ends, the invention then comprises the features particularly pointed out in the claims, these being indicative, however, of but a few of the various ways in which the principles of the invention may be employed.

What is claimed is:

1. A tool for forming a reinforcing bar connection comprising:

opposed drivers adapted each to engage a seat supporting a tapered sleeve positioned over bar ends; and means to drive the seats axially of the bar ends to force the sleeves over a jaw assembly positioned on the bar ends to cause the jaw assembly to contract and grip the bar ends;

wherein the means to drive the seats includes:

a pair of arms each engaging a respective seat for movement toward each other;

power means to move said arms toward each other; and cam means translating movement of said power means to said arms.

2. A tool as set forth in claim 1 including a collar forming the respective seats, and a self-releasing collet in each collar.

3. A tool as set forth in claim 1, wherein the tool does not translate relative to the bar ends as the seats are driven axially of the bar ends.

4. A tool for forming a reinforcing bar connection comprising:

opposed drivers adapted each to engage a seat supporting a tapered sleeve positioned over bar ends; and means to drive the seats axially of the bar ends to force the sleeves over a jaw assembly positioned on the bar ends to cause the jaw assembly to contract and grip the bar ends;

wherein the means to drive the seats includes:

a pair of arms each engaging a respective seat for movement toward each other; and power means to move said arms toward each other; and wherein said power means comprises a piston-cylinder assembly, and a cam roller driven by said piston-cylinder assembly to move said arms.

5. A tool as set forth in claim 4 including a cam on one arm engaging said roller, and a tension link connecting said roller to said other arm.

6. A tool as set forth in claim 5 wherein said arms are coaxially pivoted together.

7. A tool as set forth in claim 6 wherein said piston-cylinder assembly is pivotally supported by a mounting bracket extending from said coaxial pivot and secured to one arm.

8. A tool as set forth in claim 4 including two cam rollers driven by said piston-cylinder assembly, and a cam on each arm engaging a respective roller.

9. A tool as set forth in claim 8 including truss means connecting said rollers and to said piston-cylinder assembly.

10. A tool as set forth in claim 9 wherein said arms are pivoted to said piston-cylinder assembly each on opposite sides thereof.

11. A tool for forming a reinforcing bar splice comprising:

a pair of pivoting arms, the distal ends of which form oppositely facing drivers adapted to engage seats receiving oppositely facing tapered sleeves positioned over aligned bar ends;

power means to drive the seats axially of the bar ends to fame the sleeves over a jaw assembly positioned on the bar ends to cause the jaw assembly to contract to grip and splice the bar ends; and cam means driven by said power means to obtain a mechanical advantage in movement of said seats.

12. A tool as set forth in claim 11, wherein the power means includes a fluid piston-cylinder assembly operative to pivot said arms to drive the seats axially of the bar ends.

13. A tool as set forth in claim 12, including means to apply pressure to the blind end of the piston-cylinder assembly to force the sleeves over the jaw assembly.

14. A tool as set forth in claim 11 wherein said cam means is on one arm.

15. A tool as set forth in claim 11 wherein said cam means is on both arms.

16. A tool as set forth in claim 15 including respective roller means for said cam means driven by said power means.

17. A tool as set forth in claim 11, including roller means driven by said power means engaging said cam means.

18. A tool as set forth in claim 11 including the seats, and means to open and close said seats for positioning on said bar ends.

19. A tool as set forth in claim 11, wherein the tool does not translate relative to the bar ends as the seats are driven axially of the bar ends.

20. A rebar tool comprising:

power operated pivoting arms, a distal end of each arm being provided with a notch to accommodate a bar passing therethrough, each distal end also including a bearing section on each side of the notch, with a rounded surface operative to engage and drive rebar tooling when said arms are closed, power means to close said arms, and cam means on at least one of said arms to cause said power means to pivot said arms.

21. A rebar tool comprising:

power operated pivoting arms, a distal end of each arm being provided with a notch to accommodate a bar passing therethrough, each distal end also including a bearing section on each side of the notch, with a rounded surface operative to engage and drive rebar tooling when said arms are closed, a piston-cylinder assembly to close the arms, and a cam roller coupled to the piston-cylinder assembly, wherein the cam roller engages a cam surface on at least one of the arms to cause the piston-cylinder assembly to pivot the arms.

22. A rebar tool as set forth in claim 21 including bar shear tooling driven by said arms.

23. A rebar tool as set forth in claim 21 including bar forming tooling driven by said arms.

24. A rebar tool as set forth in claim 21 including coupling forming wedge sleeve driving tooling driven by said arms.

25. A tool for forming a reinforcing bar connection, comprising:

a pair of arms adapted each to engage a respective seat supporting a tapered sleeve positioned over bar ends; and a cam roller engaging a cam surface on one of the arms to thereby drive the seats axially of the bar ends to force the sleeves over a jaw assembly positioned on the bar ends to cause the jaw assembly to contract and grip the bar ends.

26. The tool of claim 25, wherein the cam roller is coupled to the other of the arms by a tension link.

27. The tool of claim 26, wherein the tension link is pivotally coupled to the other of arms by a pivot pin.

28. The tool of claim 26, wherein the tension link is coupled to another cam roller that engages a cam surface on the other of the arms.

29. The tool of claim 25, wherein the arms are pivotally coupled to one another about a common pivot point.

30. The tool of claim 25, wherein the arms each have a notch to accommodate a reinforcing bar passing thereinto.

31. The tool of claim 25, further comprising a piston-cylinder assembly coupled to the cam roller, to drive the cam roller and thereby to move the arms.

32. A tool for forming a reinforcing bar splice, comprising:

a pair of pivoting arms, the distal ends of which form oppositely facing drivers adapted to engage seats receiving oppositely facing tapered sleeves positioned over aligned bar ends;

a piston-cylinder assembly to drive the seats axially of the bar ends to force the sleeves over a jaw assembly positioned on the bar ends to cause the law assembly to contract to grip and splice the bar ends; and a cam roller coupled to the piston-cylinder assembly and engaging a cam surface on one of the arms.

33. The tool of claim 32, wherein the cam roller is coupled to the other of the arms by a tension link.

34. The tool of claim 33, wherein the tension link is pivotally coupled to the other of arms by a pivot pin.

35. The tool of claim 33, wherein the tension link is coupled to another cam roller that engages a cam surface on the other of the arms.

36. The tool of claim 32, further comprising an additional cam roller that engages a cam surface on the other of the arms.

37. A tool for forming a reinforcing bar connection, comprising:

a pair of arms adapted each to engage a respective seat supporting a tapered sleeve positioned over bar ends;

a tension link coupling the arms together; and a cam roller that engages a cam surface to drive the seats axially of the bar ends to force the sleeves over a jaw assembly positioned on the bar ends to cause the jaw assembly to contract and grip the bar ends.

38. The tool of claim 37, wherein the cam surface is on one of the arms.

39. The tool of claim 38, wherein the cam roller is pivotally coupled to the other of the arms by the tension link.

40. The tool of claim 37, wherein the arms are pivotally coupled to one another about a common pivot point.

41. The tool of claim 37, wherein the arms each have a notch to accommodate a reinforcing bar passing thereinto.

42. The tool of claim 37, further comprising a piston-cylinder assembly engaging the cam roller and the cam surface.

* * * * *